United States Patent [19]

Takagi et al.

[11] 4,311,887

[45] Jan. 19, 1982

[54] HANDLE OPERATING MECHANISM FOR USE WITH AN ELECTRIC CIRCUIT BREAKER

[75] Inventors: Masatomo Takagi, Hachioji; Takanori Hagawa, Oume; Seietsu Takamatsu, Hamura; Isao Ookoshi, Tama, all of Japan

[73] Assignee: Tokyo Shibaura Denki Kabushiki Kaisha, Kanagawa, Japan

[21] Appl. No.: 96,306

[22] Filed: Nov. 21, 1979

[30] Foreign Application Priority Data

Dec. 28, 1978 [JP] Japan ..... 53-161126

[51] Int. Cl.[3] ..... H01H 27/00

[52] U.S. Cl. ..... 200/42 T

[58] Field of Search ..... 200/42 T, 153 H, 337, 200/44

[56] References Cited

U.S. PATENT DOCUMENTS

| | | | |
|---|---|---|---|
| 2,645,688 | 7/1953 | Smidt et al. | 200/42 T |
| 3,171,908 | 3/1965 | Malota | 200/337 |
| 3,192,334 | 6/1965 | Dimond et al. | 200/42 T |
| 4,233,481 | 11/1980 | Kruger | 200/153 H |

*Primary Examiner*—Willis Little

*Attorney, Agent, or Firm*—Oblon, Fisher, Spivak, McClelland & Maier

[57] ABSTRACT

A handle operating mechanism adapted for use with an electric circuit breaker including a manually operable handle member, an operating axle having an elongated hole formed therein, a cylindrical member having a guide hole of predetermined formation provided therein, and a pin engaged with each of the above members. In a certain position, when the handle is moved in the axial direction of the operating axle, a hole is formed on the handle for cooperation with a locking member.

4 Claims, 15 Drawing Figures

HANDLE OPERATING MECHANISM FOR USE WITH AN ELECTRIC CIRCUIT BREAKER

BACKGROUND OF THE INVENTION

1. Field of the Invention

This invention relates to a handle operating mechanism for use with an electric circuit breaker which is built into a metal-board switchgear, such as a control center, etc.

2. Description of the Prior Art

Electric circuit breakers are known of the type including a toggle type operating member and a rotary or twist type manually engageable handle member connected to the toggle type operating member by an adapting mechanism.

Generally, it is necessary to keep and lock the circuit breaker used for the control center at certain positions because dangerous accidents may occur by the throw-in of the circuit breaker, or by unintentionally cutting of the circuit breaker off due to important load of the circuit.

Such a prior handle operating mechanism for use with the circuit breaker is disclosed in, for example, U.S. Pat. No. 3,260,808, issued July 12, 1966.

However, many problems exist in such patent since it requires assembly of many parts and many steps for processing or assemblying. Furthermore, such patent requires provision for a handle base having an uneven opening for restricting the scope of the handle rotation except upon mounting of the handle on the surface of the door. Furthermore, such patent requires formation of an uneven opening or hole on the surface of the door or mounting of metal fittings for locking the handle.

SUMMARY OF THE INVENTION

Accordingly, it is an object of this invention to provide a handle operating mechanism for use with an electric circuit breaker in which the number of parts and number of steps of the operation, assembly and manufacture are reduced, and the operation and assembly are simplified.

Briefly, in accordance with one aspect of this invention, a handle operating mechanism is provided which includes a manually operable handle member, an operating axle having an elongated hole formed therein interconnecting the operating handle member and the electric circuit breaker, means for engaging the operating axle with the operating handle member, said engaging means being disposed within the elongated hole of the operating axle, and means for guiding the movement of the handle member.

BRIEF DESCRIPTION OF THE DRAWINGS

A more complete appreciation of this invention will be readily obtained as the same becomes better understood by reference to the following detailed description when considered in connection with the accompanying drawings, wherein.

DETAILED DESCRIPTION OF THE PREFERRED EMBODIMENTS

Figure 1:
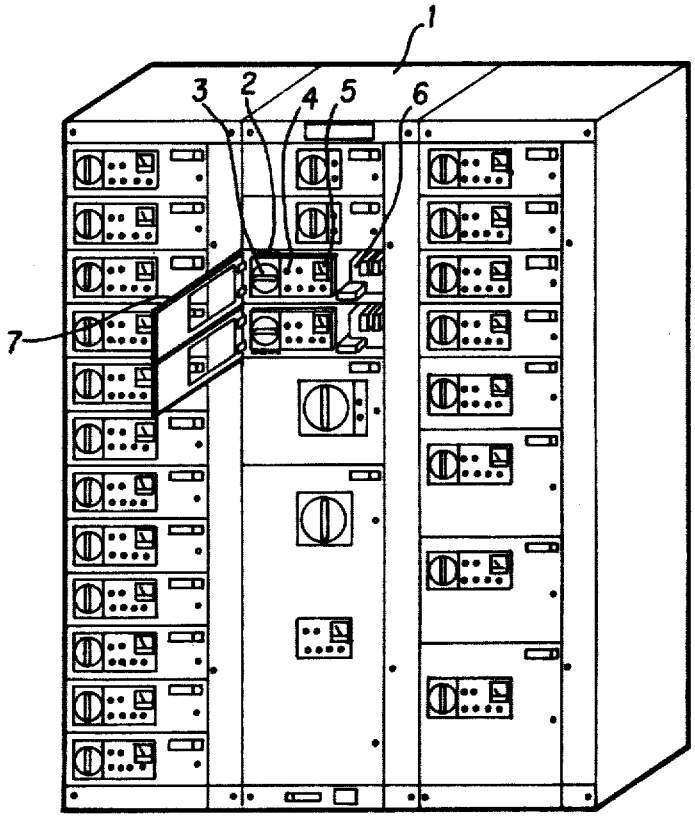
FIG. 1 is a perspective view of a control center for use with a handle operating mechanism according to this invention.

Referring now to the drawings, wherein like reference numerals designate identical or corresponding parts throughout the several views, the present invention is shown as embodied in a control center illustrated in FIG. 1 and includes multiple stages of control units 6 each having a circuit breaker 2, a handle 3 for actuating the circuit breaker, a control-changeover switch 4, meter instruments 5 and other instruments of an electromagnetic switch and relay system (not shown) in the enclosure 1. Each of the control units 6 is covered by a front door 7.

Figure 2:
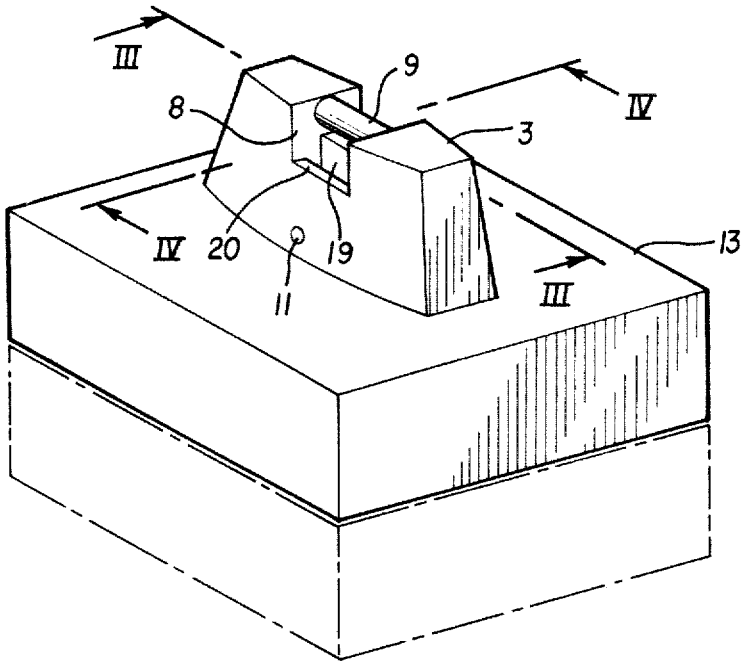
FIG. 2 is a perspective view of a handle operating mechanism according to this invention.
Figure 3:
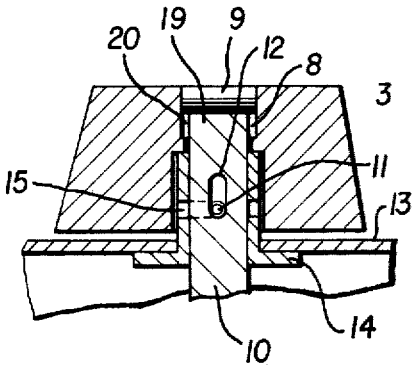
FIG. 3 is a sectional view taken partly along lines III—III of FIG. 2.
Figure 4:
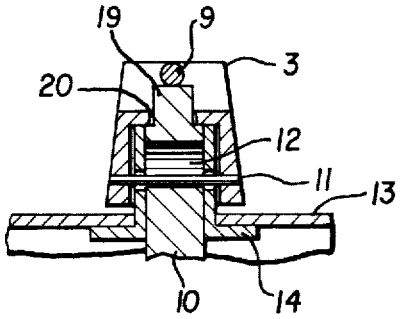
FIG. 4 is a sectional view taken partly along lines IV—IV of FIG. 2.

In FIGS. 2, 3 and 4, the handle member 3 has a hole 8 formed therein and a bowstring member 9 to mount a bowstring of a padlock and is engaged with an operating axle 10 for actuating the circuit breaker by an engaging means, such as a pin 11 (as shown in FIGS. 3 and 4).

The pin 11, as shown in FIG. 3, is passed through an elongated hole 12 formed in the operating axle 10 and axially moved along the elongted hole 12.

Therefore, the handle 3 and the operating axle 10 move as one body because of engagement of the pin 11 with handle 3.

Figure 5:
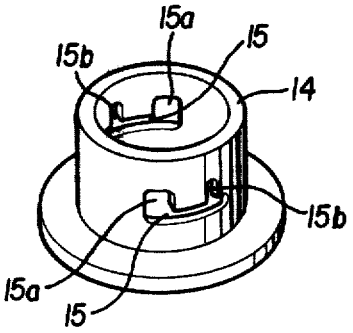
FIG. 5 is an enlarged perspective view of the cylindrical member shown in FIGS. 3 and 4.

A guiding means, such as a cylindrical member 14 is mounted on a unit 13 to support the operating axle 10. As shown in FIG. 5, a guide hole 15 through which the pin 11 passes and which restricts axially and radially movement of the operating axle 10 is provided in the cylindrical member 14.

Figure 6:
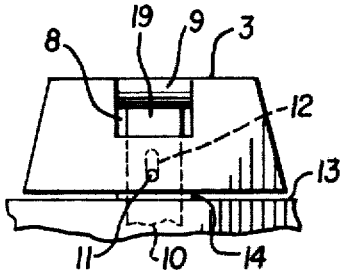
FIGS. 6 and 9 are side views of the handle member shown in FIG. 2.
Figure 7:
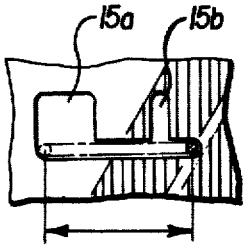
FIGS. 7 and 10 are extended views of the guide hole shown in FIG. 5.
Figure 8:
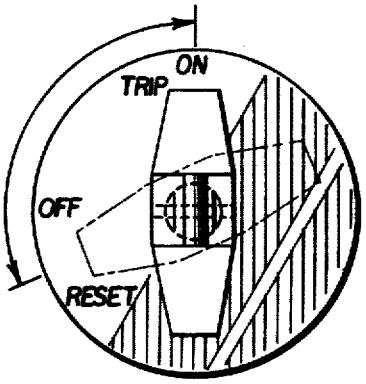
FIG. 8 and 11 are plan views of the handle shown in FIG. 2.

Accordingly, the handle 3 can be pushed or pulled in the axial direction of the operating axle 10 only when the pin 11 is positioned in line with the grooves **15*a* and 15*b* of the guide hole 15, and in such case, the degree of movement of the handle 3 can be restricted. That is, in the cylindrical member 14 having the guide hole 15, as shown in FIG. 5, since the pin 11 can be moved within range shown by oblique lines, as shown in FIG. 7, to a position such that the handle 3 is pushed as shown in FIG. 6, it is possible to move the handle 3 in a full range from an ON position to a RESET position shown by the arrow in FIG. 8**.

Figure 9:
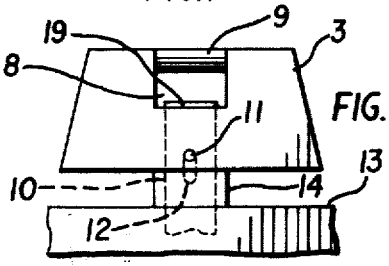
Figure 10:
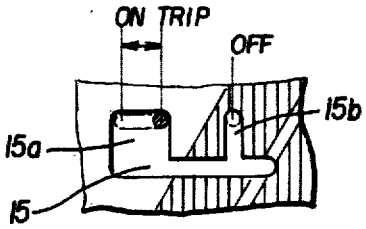
Figure 11:
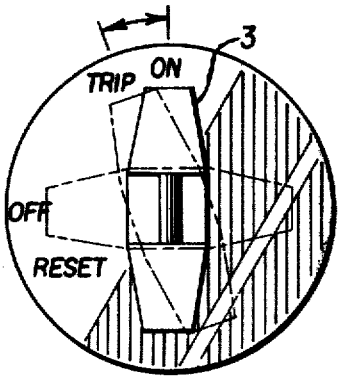

On the other hand, in case the handle 3 is pulled, as shown in FIG. 9, at the ON position, the handle can be moved only in the range shown by oblique lines of FIG. 10, i.e., from the ON position to the TRIP position shown by the arrow in FIG. 11.

Furthermore, in case the handle 3 is pulled at the OFF position, it is restricted so as to not be able to rotate the handle 3 at 15*b* of FIG. 10, i.e. the OFF position of FIG. 11.

A hole 20 capable of extending an end terminal 19 of the operating axle is provided at the bottom of the hole 8 for passing of the bowstring of the padlocking therethrough.

For such construction described, in case the handle 3 is pushed in the axial direction of the operating axle 10, the hole 8 is closed by the end terminal 19 of the operating axle 10 and therefore the padlock cannot be mounted on the handle 3 and vice versa.

As described hereinabove, the elongated hole 12 of the operating axle, the guide hole 15 of the cylindrical member 14, the pin 11 engaged with the handle member 3 which is passed through the holes 12 and 15, the hole 8 and the bowstring 9 of the handle member 3, and the end terminal 19 of the operating axle 10, etc. are structurally and operationally interrelated to each other and perform the following functions. More particularly, in case the handle 3 is pushed (without being locked), the handle 3 is capable of rotation to all positions: i.e. ON, TRIP, OFF, and RESET.

Furthermore, in case that the handle 3 is pulled at the OFF position and the padlock is locked, the handle 3 cannot rotate to any position except ON or OFF, where only when the circuit breaker is tripped by an abnormal current at the ON position of the handle 3, and the handle 3 be rotated from the ON position on TRIP position in response to trip operation.

It should, accordingly, be understood that this embodiment of the invention provides all the needed functions of a handle operating mechanism. Also, in accordance with this handle operating mechanism, since after the cylindrical member 14 is mounted on the unit panel 13, the operating axle 10 is inserted from the back of the panel 13 into the cylindrical member 14, and the handle 3 is then mounted on the operating axle 10 from the front of the panel 13 and is fixed by the pin 11 from the side face of the handle 3, it is not difficult to assemble or adjust and its' assembly or manufacture is simple and easy.

Figure 12:
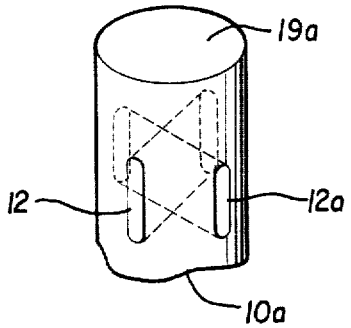
FIGS. 12, 13 and 14 are perspective views illustrating, respectively, modifications of an end terminal of the operating axle shown in FIGS. 3 and 4.
Figure 13:
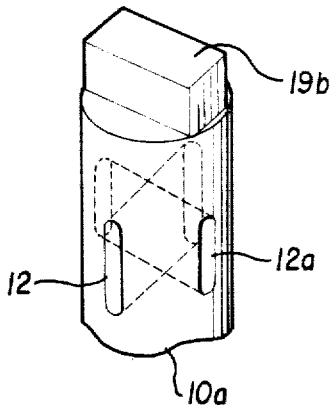

Furthermore, this invention is not limited to the above-mentioned embodiment. For example, as shown in FIGS. 12 and 13, if an additional elongated hole 12*a* is provided at a position biased 90 degrees from that of the elongated hole 12 of the operating, and the sectional formation of the end terminal 19 of the axle 10*a* is formed in a round formation 19*a* in FIG. 12 or square formation 19*b* of FIG. 13, in case the circuit breaker 2 and unit panel 13 are mounted at a position rotated 90 degrees, the operating position and angle of the handle 3 does not vary. The circuit breaker can be used at a position corresponding to both angles, i.e. along their length and breadth.

Figure 14:
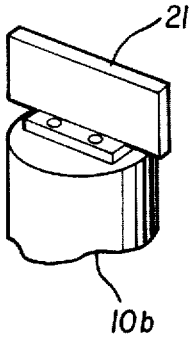

Furthermore, as shown in FIG. 14, if a shutting member 21 is attached to the end terminal of the operating axle 10*b*, it is possible to freely select the area or formation of the hole 8 for locking with the bowstring of the padlock.

Figure 15:
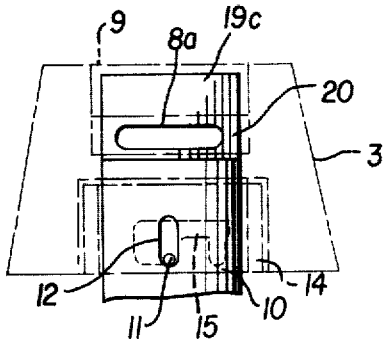
FIG. 15 is a side view showing a modification of an end terminal of the operating axle shown in FIGS. 3 and 4.

If the guide hole 15 of the cylindrical member 14 as shown in FIG. 5 is attached in the opposite direction, as shown in FIG. 15, an additional hole for engagement with the bowstring of the padlock is provided in the end terminal or shutting member 19*c* of the operating axle 10, it is possible to restrict the rotatable range when the handle 3 is pushed. Conversely, when the handle 3 is pulled it is possible to rotate the handle 3 through its full range.

It should now be apparent that in accordance with the teachings of this invention, only by using a minimal number of parts including a handle, operating axle, cylindrical member, and pin for engaging, and by modifying these formations, it is possible to reduce the number of parts and the assembly process steps in manufacture of the handle operating mechanism.

Obviously, many modifications and variations of this invention are possible in light of the teachings of this invention. It is therefore to be understood that within the scope of the appended claims the invention may be practiced otherwise than as specifically described herein.

What is claimed as new and desired to be secured by letters patent of the United States of America is:

1. A rotary handle operating mechanism for use with an electric circuit breaker comprising:
   - a manually operable handle member;
   - an operating axle having an elongated hole formed therein interconnecting the handle member and the electric circuit breaker;
   - means for engaging the operating axle with the handle member, said engaging means being disposed within the elongated hole of the operating axle;
   - means for guiding the movement of the handle member, said handle member including a hole formed therein, said hole being positioned between the handle member and the operating axle when the handle member is moved in the axial direction of the operating axle; and
   - locking means operatively associated with the hole in the handle means for locking the handle means at a predetermined position.

2. A rotary handle operating mechanism for use with an electric circuit breaker comprising:
   - a manually operable handle member;
   - an operating axle having an elongated hole formed therein interconnecting the handle member and the electric circuit breaker;
   - means for engaging the operating axle with the handle member, said engaging means being disposed within the elongated hole of the operating axle; and
   - means for guiding the movement of the handle member, said operating axle including a first and second pair of elongated holes formed therein so as to cross each other in alignment and which are selectively cooperable with the engaging means.

3. A rotary handle operating mechanism for use with an electric circuit breaker comprising:
   - a manually operable handle member;
   - an operating axle having an elongated hole formed therein interconnecting the handle member and the electric circuit breaker;
   - means for engaging the operating axle with the handle member, said engaging means being disposed within the elongated hole of the operating axle; and
   - means for guiding the movement of the handle member, said guiding means comprising a cylindrical member having a pair of guide holes formed therein such that the engaging means is disposed therein and positioned adjacent the operating axle.

4. An electric switch assembly comprising:
   - an electric circuit breaker;
   - means for activating the circuit breaker;
   - a manually operable handle member engaged with the means for actuating the circuit breaker;

an operating axle having an elongated hole formed therein and interconnecting the handle member and the electric circuit breaker;

means for engaging the operating axle with the handle member, said engaging means being disposed within the operating axle; and a cylindrical member having a pair of guide holes formed therein positioned adjacent the operating axle such that said engaging means is disposed within said pair of guide holes, said cylindrical member including a guiding portion to guide rotation of the operating axle by engagement with the engagement means and a locking portion for locking the operating axle at a predetermined position by means of movement of the engaging means.

* * * * *